United States Patent [19]

Jerry et al.

[11] Patent Number: 5,038,749

[45] Date of Patent: Aug. 13, 1991

[54] COOK STOVE AND STAND

[76] Inventors: George J. Jerry, 2602 Manila La., Houston, Tex. 77043; Albert B. Fay, Jr., 5719 Indian Trail, Houston, Tex. 77057

[21] Appl. No.: 544,128

[22] Filed: Jun. 26, 1990

[51] Int. Cl.[5] ..... F24C 3/08

[52] U.S. Cl. ..... 126/40; 126/38; 126/44

[58] Field of Search ..... 126/25 R, 9 R, 40, 44, 126/38, 214 D; 431/353, 351, 344; 248/157, 163.1; 297/461

[56] References Cited

U.S. PATENT DOCUMENTS

| | | | |
|---|---|---|---|
| 192,011 | 6/1877 | Richardson | 126/40 |
| 494,470 | 3/1893 | Edwards | 126/40 |
| 545,783 | 9/1895 | Dressler | 126/40 |
| 955,140 | 4/1910 | Cronk | 126/40 |
| 1,275,301 | 8/1918 | Pickup | 126/40 |
| 2,447,925 | 10/1945 | Vorbusch | 126/40 |
| 4,177,790 | 12/1979 | Zenzaburo | 126/40 |
| 4,364,372 | 12/1982 | Johnson | 126/40 |
| 4,726,350 | 2/1988 | Steinhauser | 126/40 |
| 4,809,671 | 3/1989 | Vallejo, Jr. | 126/40 |

*Primary Examiner*—James C. Yeung
*Attorney, Agent, or Firm*—David A. Rose; Ned L. Conley; Jeffrey W. Tayon

[57] ABSTRACT

A portable cook stove and stand includes a ring supported by three legs with braces and struts extending between the legs. A burner plate is supported by bi-level brackets attached to the legs adjacent the ring. The burner plate includes a deflector pan in which is mounted a fuel jet in communication with a fuel tank. The burner plate is supported by the brackets at a predetermined distance below the ring such that the ring acts as a wind break for the flame.

19 Claims, 3 Drawing Sheets

COOK STOVE AND STAND

BACKGROUND OF THE INVENTION

This invention relates to cooking apparatus and more particularly to a portable cook stove and stand.

Various types of portable grills, hibachis, patio stoves, and camping apparatus are shown in the prior art. Such prior art apparatus do not support the stove at a convenient height or, if at a convenient height, are not adequately portable or collapsible for storage. Further, prior art cooking apparatus are not aesthetically pleasing.

U.S. Pat. No. 955,140 to Cronk discloses a camping apparatus wherein a tripod is utilized to support a fire box for cooking food over a campfire. The legs of the tripod are formed in sections which are joined together by tubular members and clamping screws.

U.S. Pat. No. 192,011 to Richardson discloses a portable lamp-stove wherein the cooking surface is supported by a tripod stand so that the heat from the portable lamp-stove is used to warm the contents of the cooking utensil.

Other patents show the state of the art with regard to cooking units and the supports therefor. U.S. Pat. No. 4,364,372 shows a torch-type heating device with a removably mounted grill and pivotally attached handle assembly convertible to a tripod support. Shields are mounted adjacent opposite ends of the torch tube to render the heating device wind-proof. U.S. Pat. No. 4,809,671 discloses a cooking unit having an adjustable and removable wind-shield. U.S. Pat. No. 545,783 discloses a gas burner having a support for vessels to be heated. U.S. Pat. No. 1,275,301 discloses a gas hotplate with frame. U.S. Pat. No. 2,447,925 discloses a gas burner with a supporting stand. U.S. Pat. No. 4,177,790 discloses a pocket camp stove having wire leg members. A cook stove under the name of "Primus" is manufactured by Century Tool and includes a burner plate with associated fuel tank.

SUMMARY OF THE INVENTION

The present invention includes a three-legged ring stand for supporting a cook stove, such as a propane stove. The stand includes a ring which is butt-jointed to the tops of three legs. Each leg includes an upper section and a lower section which are joined by a tube joint. The tube joints include threaded fasteners for attaching the lower sections to the upper sections. The stand includes an equilateral triangular brace with V-shaped struts extending from the triangular brace to adjacent lower sections of the legs. The upper legs with ring stand may be detached from the lower legs with brace and struts for storage. Each leg includes a bi-level bracket for supporting a burner plate at two different heights. The burner plate is supported a predetermined distance from the ring such that the ring acts as a wind break.

Other objects and advantages of the present invention will appear from the following drawings and description.

BRIEF DESCRIPTION OF THE DRAWINGS

For a detailed description of the preferred embodiment of the invention, reference will now be made to the accompanying drawings, wherein.

DESCRIPTION OF THE PREFERRED EMBODIMENTS

Figure 1:
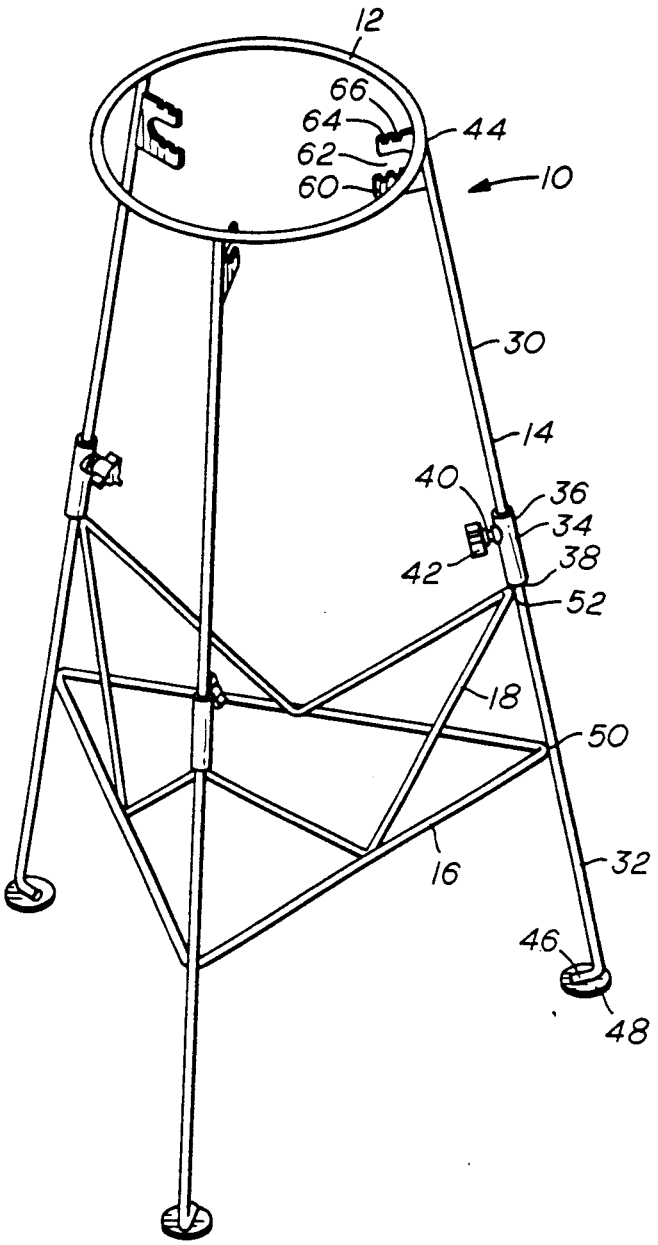
FIG. 1 is a perspective view of the stand of the present invention.
Figure 2:
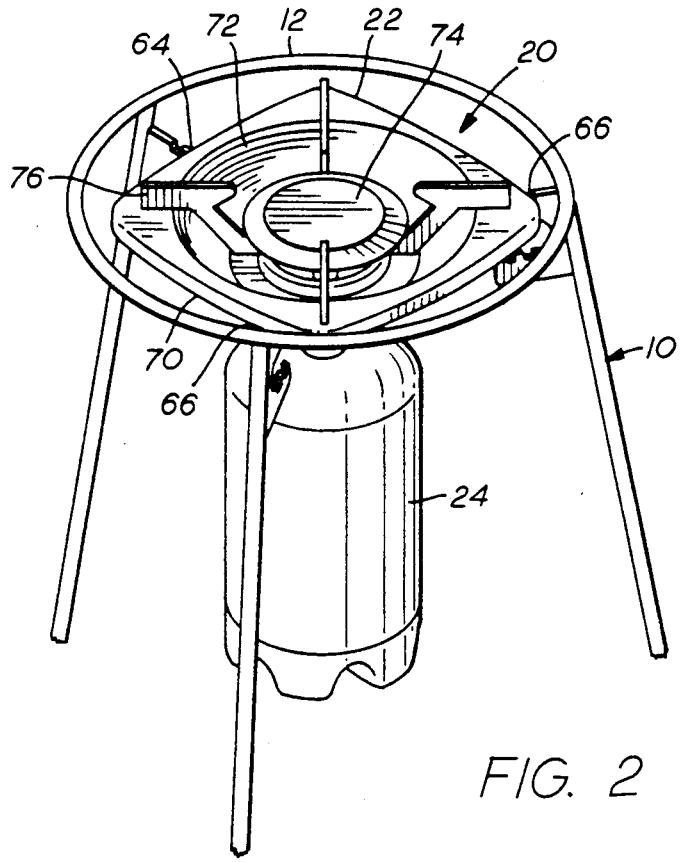
FIG. 2 is a perspective view of the upper portion of the stand of FIG. 1 having the stove of the present invention supported in its uppermost position.

The present invention includes a stand 10 as shown in FIG. 1 and a cook stove 20 as shown in FIG. 2. The stand 10 is portable and collapsible as hereinafter described. The stove 20 includes a burner plate 22 and a fuel tank 24. The height of the burner plate 22 may be adjusted on the stand 10.

Referring initially to FIG. 1, the stand 10 of the present invention includes a ring 12, three legs 14, a triangular leg brace 16 and V-shaped struts 18. The ring 12 is dimensioned to have a diameter, preferably 9½" to 9¾", which will accommodate the bottom of most cooking utensils such as woks, sauce pans and frying pans. The ring 12 is made of a solid mild steel and preferably is ⅜" rod stock.

Each of the legs 14 include an upper section 30 and a lower section 32. Leg sections 30, 32 are made of solid mild steel and are preferably made of ⅜" rod stock. Leg sections 30, 32 are detachably connected together by attachment means 34. Attachment means 34 is a tube joint and includes a splicing tube or socket 36 having an inner diameter sized to slidably receive the ends of leg sections 30, 32. The upper end of lower leg section 32 is received within the lower end of tube 36 and welded within tube at 38. A tapped aperture is provided through the side of tube 36 to receive a set screw 40 having a plastic knob 42. The tapped hole for set screw 40 may include a nut or bolt aligned with an aperture through the side of tube 36 and then welded to tube 36.

The upper leg section 30 is received through the upper end of tube 36 until it engages the upper terminal end of lower leg 32 welded into tube 36, thus serving as a stop. Knob 42 is then utilized for threading set screw 40 into the interior of tube 36 to engage the lower end of upper leg section 30. The set screw 40 may be molded into the knob 42. The plastic knobs 42 are manufactured by Davis Molding of Chicago, Illinois. The upper end of upper leg section 30 is welded at 44 to the lower side of ring 12. The legs 14 are welded to ring 12 such that legs 14 are circumferentially spaced around ring 12 and are approximately 10° from vertical. It has been found that four legs cause instability in that the use of four legs requires that each leg contact four different surfaces of the floor at a common level. If one of the contact surfaces is not level with the other three, the stand would tend to rock causing instability.

Each lower leg section 32 includes a turned-in foot portion 46. A circular pad 48 is welded to the bottom of foot portion 46 by resistance welding. The foot portion 46 is turned in to prevent the foot portion from becoming an obstacle to traffic. The pad 48 is sized so as to prevent the foot portion 46 from passing through a hole or aperture in the supporting surface for the stand such as a wood deck. The turned-in feet 46 and pads 48 add to the aesthetics of the stand 10.

Triangular braces 16 are made of a solid mild steel and preferably from 5/16" rod stock. Although triangular braces 16 may be made of three individual braces, it is preferably made of one triangular piece having the ends welded together at 50, for example. Triangular braces 16 maintain the legs 14 and particularly the lower leg sections 32 at a constant spread thereby insuring the stability of the stand 10.

The V-shaped struts 18 are also made of a solid mild steel, and preferably of ¼" rod stock. Although the V-shaped struts 18 may be made of three individual V-shaped struts, it is preferred that the V-shaped struts 18 are made of one piece with the ends welded together such as at 52, for example. The V-shaped struts 18 prevent distortion of the stand 10 in any plane.

As can be seen from the above-identified description, the stand 10 is made of a solid mild steel. The stand 10 has a preferred height of 32" and a spread of 18" between adjacent legs 14. It is preferred that the stand weigh at least 9½ to 10 pounds to prevent the stand from blowing over or tilting due to the wind. It has been found that tubing is too light and does not provide sufficient weight for the stand 10.

Bi-level brackets 60 are welded on the inside of the upper end of each upper leg section 30. The bi-level brackets 60 are generally rectangular metal plates having a central slot 62. A pair of inner and outer notches 64, 66, respectively, are provided in each of the upwardly facing edges of bi-level brackets 60. The notches 64, 66 are sized to receive the edge 70 of the burner plate 22 as hereinafter described. The notches 64, 66 are disposed on bi-level brackets 60 at a predetermined distance from the notches 64, 66 of the other bi-level brackets 60. The predetermined distance permits the outer notch 66 of one bi-level bracket 60 to receive the edge 70 of the burner plate at the same time that the two inner notches 64 of the other two bi-level brackets 60 also receive the edge 70 of the burner plate. Thus, the bi-level brackets 60 permit the burner plate 22 to face any one of the three legs 14.

Figure 3:
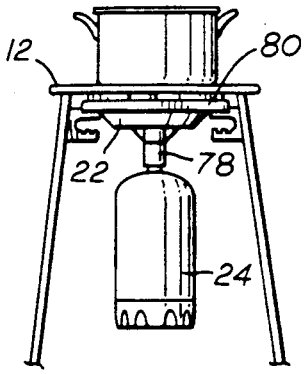
FIG. 3 is an elevation view of the stand and stove of FIG. 2 with the stand supporting a utensil.

Referring now to FIG. 2, there is shown the cook stove 20. Burner plate 22 is a generally square plate made of sheet metal and having a generally downwardly projecting peripheral edge 70. The burner plate 22 further includes a centrally disposed and generally conical well forming a reflector pan 72 in which is disposed one or more fuel jets 74. A plurality of burner grates 76 rest on burner plate 22 and extend downwardly into the reflector pan 72 adjacent fuel jet 74. As shown in FIG. 3, fuel tank 24 is attached to the bottom of burner plate 22 so as to be in flow communication for the fuel to flow to fuel jet 74. Tank 24 is preferably a one pound or fourteen ounce disposable propane fuel tank. A valve 78 is provided to regulate the flow of fuel to gas burner 74. The cook stove 20 is manufactured by Chung Mei of Kwaloon, Hong Kong.

As shown in FIG. 2, the camp stove 20 when assembled onto stand 10, has one portion of peripheral edge 70 received by an inner notch 64 of one bi-level bracket 60 and other portions of the peripheral edge 70 also received in the outer notches 66 of the other two bi-level brackets 60. As shown in FIG. 3, there is a vertical clearance 80 of approximately ¼" to ½" between the top of burner plate 22 and the plane formed by the bottom periphery of ring 12. The vertical clearance 80 permits burner plate 22 to slide below ring 12 and above bi-level brackets 60 to be installed onto stand 10. Further, this preferential vertical clearance 80 also serves to provide the necessary combustible air for the burner plate 22. The ring 12 has sufficient mass to act as a windbreak to the flame of burner plate 22. The reflector pan 72 also acts as a wind-shield or wind deflector.

Figure 4:
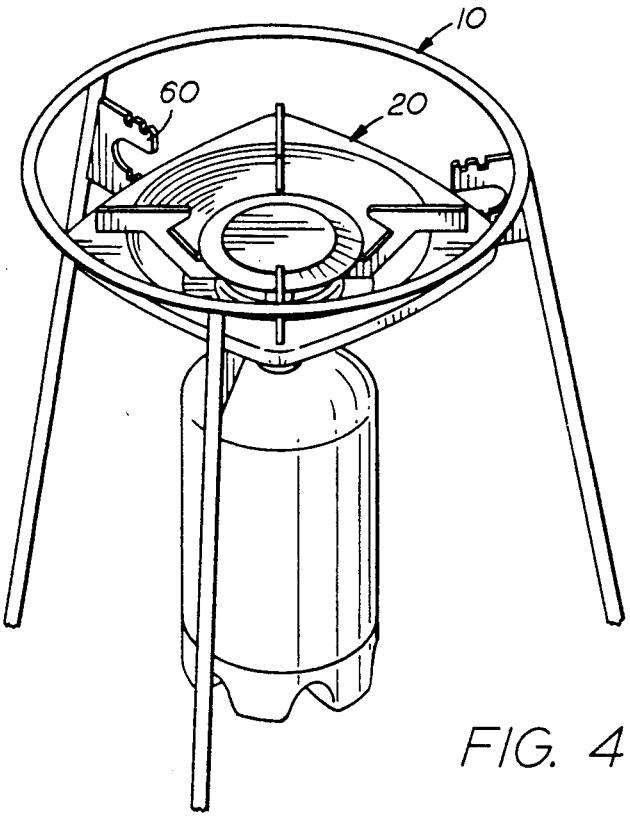
FIG. 4 is a perspective view of the stand of FIG. 1 with the stove in the lowermost position.
Figure 5:
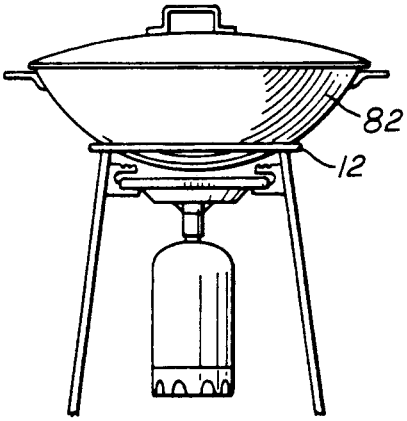
FIG. 5 is an elevation view of the stand and stove of FIG. 8 with the stand supporting a wok.
Figure 7:
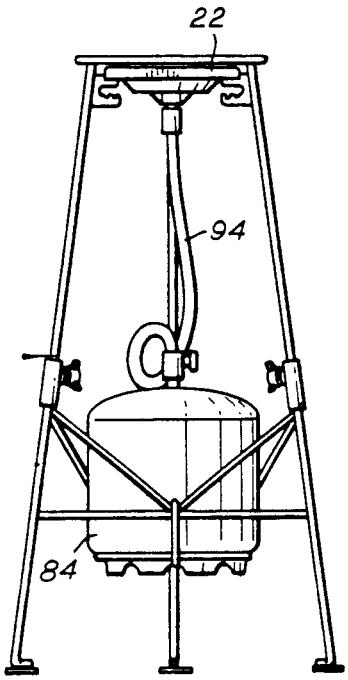
FIG. 7 is an elevation view of the stand supporting a burner plate and a fuel tank connected thereto.
Figure 6:
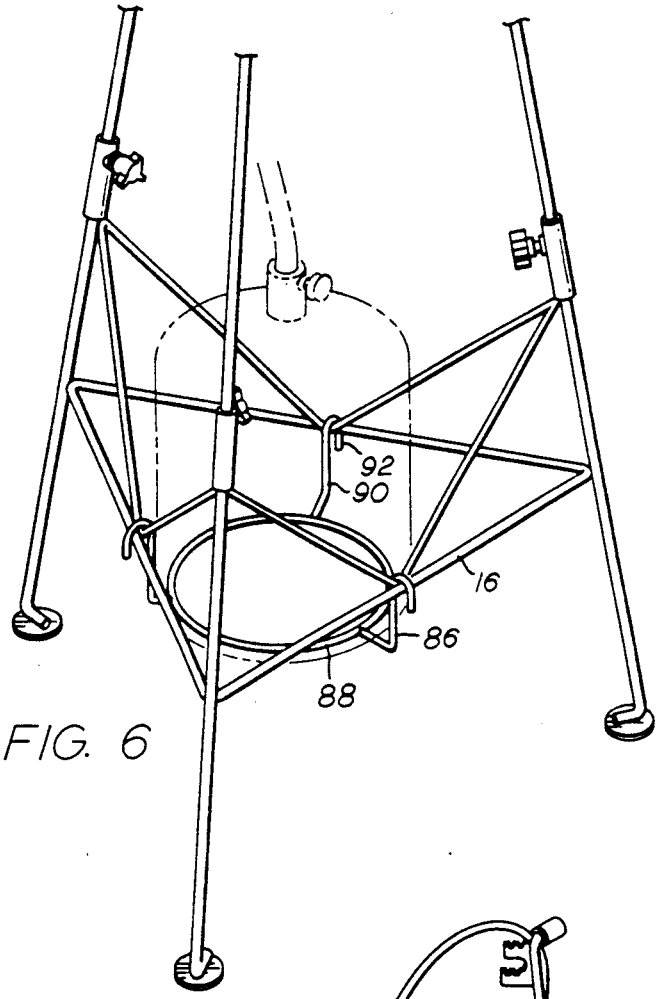
FIG. 6 is a perspective view of the lower portion of the stand having a support for a propane tank.

Referring now to FIGS. 4 and 5, the cook stove 20 is shown supported on the lower pair of notches 64, 66 of bi-level brackets 60. A wok 82 is shown in FIG. 5 supported in ring 12 with its bottom heating surface just above the burner grate 76. The average wok will clear the burner grate 76 by approximately ⅛".

It should be appreciated that the upper portion of stand 10, including upper leg sections 30 and ring 12, may be disassembled at tubes 36 from the lower portion of stand 10, including lower leg sections 32, triangular braces 16, and V-struts 18. The disassembled stand 10 may be stored with upper leg sections 30 straddling lower leg sections 32.

Although the cook stove 20 is shown in FIGS. 2–5 as having a disposable fuel tank 24, a nondisposable bulk gas tank 84 may be supported by a wire rack 86 on triangular brace 16. A flexible hose 94 extends from the top of tank 84 to burner plate 22. Wire rack 86 includes a lower ring 88 having three hook supports 90. Hook supports 90 include a wire hook 92 which is received over the brace 18 and triangular support 16. The nondisposable tank 84 rests on top of wire ring 88.

Figure 8:
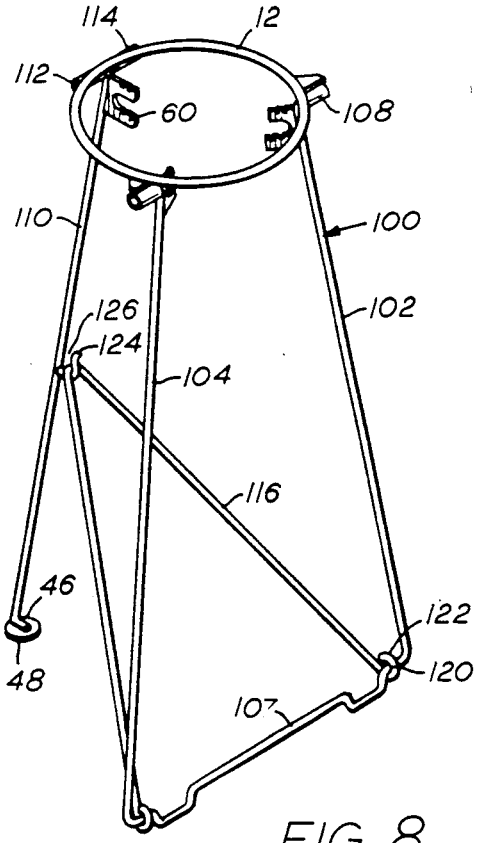
FIG. 8 is a perspective view of an alternative embodiment of the stand of FIG. 1 whereby the stand is collapsible.
Figure 9:
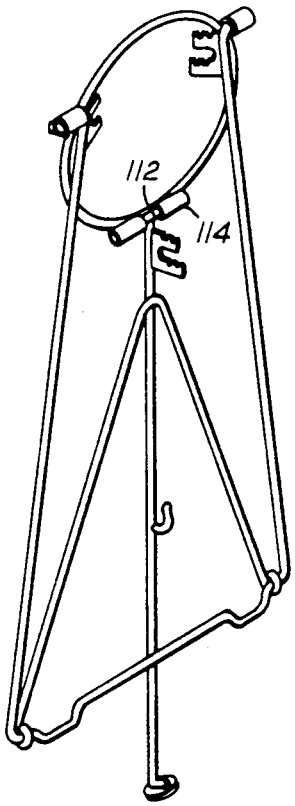
FIG. 9 is a perspective view of the collapsible stand of FIG. 8 in the collapsed position.

Referring now to FIGS. 8 and 9, there is shown an alternative embodiment of the stand 10. The stand 100 shown in FIGS. 8 and 9 is collapsible. Stand 100 includes the ring 12 and bi-level brackets 60 like that of the preferred embodiment, stand 10. Stand 100 further includes a pair of master legs 102, 104 with a base 106. Legs 102, 104 and base 106 are preferably made from a single piece of solid mild steel. The upper ends of legs 102, 104 are rotatably affixed to ring 12 by tubular hinges 108. Tubular hinges 108 are welded onto the sides of ring 12 and receive the upper terminal ends of legs 102, 104 which have been bent to project horizontally.

Stand 100 includes a third leg 110 having the turned-in foot 46 and pad 48 of the preferred embodiment at its lower terminal end. At its upper terminal end, there is provided a cross bar 112 forming a T. A pair of tubular hinges 114 receive the T-end of leg 110 which are welded to the bottom of ring 12. The hinges 108, 110 permit the legs 102, 104 and 110 to rotate with respect to ring 12 whereby ring 12 may be moved to the vertical position as shown in FIG. 9.

A V-shaped brace 116 is provided extending from the base 106 of legs 102, 104 to the midpoint of the third leg 110. The V-shaped brace 116 includes loops 120 bent around elevated horizontal portions 122 of base 106. Horizontal portions 122 and loop 120 form a hinge on each of the ends of V-shaped brace 116. The apex of V-shaped brace 116 is adapted to be disposed in a hook 124 welded to the midpoint of third leg 110. The hook 124 includes a narrow mouth 126 whereby brace 116 will snap through narrow mouth 126 and be held in place on leg 110. Base 106 includes an elevated horizontal mid-portion 107 which is above the ground so that legs 102, 104, and 110 have three points of contact to insure stability.

As shown in FIG. 9, the ring 12 rotates on hinges 108 to fold up against legs !02, 104 into the vertical position. The third leg 110 rotates downwardly on hinge 114 while V-shaped brace 116 rotates upwardly on loops 120. Thus, the stand 100 collapses to become substantially flat for storage.

Figure 10:
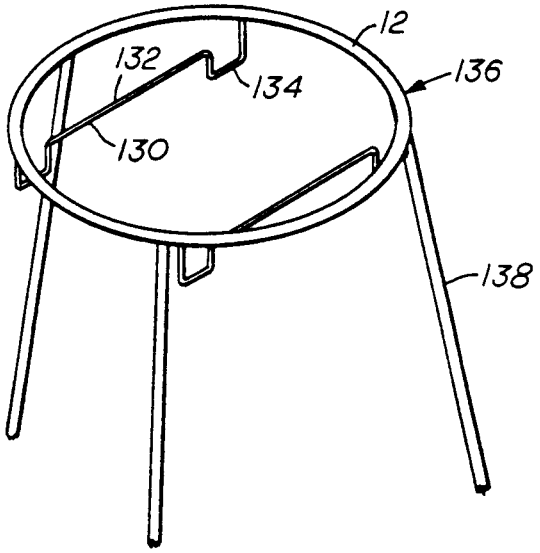
FIG. 10 is a perspective view of the upper portion of the stand having an alternative support for the stove.

Referring now to FIG. 10, there is shown an alternative stand 136. Stand 136 has shortened legs 138 which provide a stand height of approximately 12½", such height permitting a one pound fuel tank to be housed under ring 12. Although the legs 138 are shown affixed to ring 12, legs 138 may be removable by using a tube joint, such as attachment means 34, to removably attach legs 138 to ring 12. In this embodiment, bi-level brackets 60 are replaced by a pair of wire supports 130 which are affixed under ring 12. Wire supports 130 include an elevated midportion 132 forming a pair of horizontal lower notches 134. The burner plate 22 may rest its edge 70 within lower notches 134 to securely support burner plate 22 on stand 136.

While a preferred embodiment of the invention has been shown and described, modifications thereof can be made by one skilled in the art without departing from the spirit of the invention.

I claim:

1. A stand for a burner, comprising:
a ring;
three legs attached to said ring and extending downwardly therefrom;
a triangular brace extending horizontally between said legs;
a plurality of V-shaped struts each having ends attached to adjacent legs and an apex attached to said triangular base; and
support means mounted on said legs below said ring for supporting the burner.

2. The stand of claim 1 wherein each of said legs include two sections detachably connected by a joint.

3. The stand of claim 2 wherein said joint includes a tubular member attached to one of said sections and detachably connected to the other of said sections.

4. The stand of claim 3 wherein said tubular member includes an aperture for receiving said other section and means for tightening said other section within said aperture.

5. The stand of claim 4 wherein said tightening means includes a threaded member having a knob affixed thereto and threaded into said aperture to bear against said other section.

6. The stand of claim 1 wherein said support means includes a bracket affixed to each leg.

7. The stand of claim 6 wherein each said bracket includes a notch to receive the burner.

8. The stand of claim 7 wherein said bracket includes a plurality of notches to face the burner toward any one of the three legs.

9. The stand of claim 6 wherein said bracket includes bilevel supports to support the burner at two heights.

10. The stand of claim wherein said support means includes a pair of elongated members suspended below said ring.

11. The stand of claim 10 wherein said elongated members have lower elevated portions for securing the burner.

12. The stand of claim 1 wherein said support means supports the burner adjacent said ring whereby said ring serves as a barrier to wind.

13. An apparatus for outdoor cooking, comprising:
a ring;
three legs attached to said ring;
braces extending between said legs;
a burner plate;
support members attached to said legs for supporting said burner plate;
said burner plate having a well in which is mounted a fuel jet;
a fuel tank having communication means providing flow communication between said tank and fuel jet for supplying fuel;
said burner plate being supported by said support members a predetermined distance below said ring whereby said ring acts as a wind-shield for the flame from said fuel jet.

14. The apparatus of claim 13 wherein said support member includes a first support at one elevation and a second support at another elevation to allow adjustment of the elevation of said burner plate.

15. The apparatus of claim 13 wherein said burner plate includes a downwardly projecting peripheral edge engaging said support members.

16. The apparatus of claim 15 wherein said support members include a plurality of notches for receiving the peripheral edge of said burner plate.

17. The apparatus of claim 13 further including bracket means attached to said braces for supporting said fuel tank.

18. The apparatus of claim 17 wherein said bracket means includes a wire ring having a plurality of upwardly extending hooks engaging said braces.

19. The apparatus of claim 13 wherein said fuel tank is attached directly to said burner plate.

* * * * *